US006606757B2

(12) United States Patent
Vosbikian et al.

(10) Patent No.: US 6,606,757 B2
(45) Date of Patent: Aug. 19, 2003

(54) FLEXIBLE DUST MOP

(75) Inventors: Peter S. Vosbikian, Moorestown, NJ (US); Robert E. Petner, Burlington, NJ (US)

(73) Assignee: Quickie Manufacturing Corp., Cinnaminson, NJ (US)

( * ) Notice: Subject to any disclaimer, the term of this patent is extended or adjusted under 35 U.S.C. 154(b) by 371 days.

(21) Appl. No.: 09/823,962

(22) Filed: Mar. 29, 2001

(65) Prior Publication Data

US 2002/0138934 A1 Oct. 3, 2002

(51) Int. Cl.[7] ..... A47L 13/20; A47L 13/24
(52) U.S. Cl. ..... 15/118; 15/229.6; 15/231
(58) Field of Search ..... 15/118, 228, 229.1, 15/229.2, 229.3, 229.4, 229.6, 229.7, 229.8, 231

(56) References Cited

U.S. PATENT DOCUMENTS

| | | | | | |
|---|---|---|---|---|---|
| 1,437,145 | A | * | 11/1922 | Johnson | 15/210.1 |
| 1,781,460 | A | * | 11/1930 | Hertzberg | 15/229.3 |
| 2,060,012 | A | * | 11/1936 | Baker | 15/229.7 |
| 2,804,638 | A | * | 9/1957 | Vosbikian et al. | 15/229.8 |
| 3,528,076 | A | * | 9/1970 | Anderson | 15/228 |
| 3,760,450 | A | * | 9/1973 | Griffin et al. | 15/229.6 |
| 4,794,663 | A | | 1/1989 | Vosbikian | |
| 5,379,478 | A | * | 1/1995 | Vosbikian | 15/147.2 |
| 5,406,670 | A | * | 4/1995 | Juratovac et al. | 15/229.2 |
| 5,862,565 | A | * | 1/1999 | Lundstedt | 15/220.1 |
| 6,098,239 | A | | 8/2000 | Vosbikian | |

FOREIGN PATENT DOCUMENTS

| | | | |
|---|---|---|---|
| JP | 06-154145 | * | 6/1994 |
| JP | 07-194511 | * | 8/1995 |
| JP | 2002-65545 | * | 3/2002 |

* cited by examiner

*Primary Examiner*—Terrence R. Till
(74) *Attorney, Agent, or Firm*—Stuart M. Goldstein

(57) ABSTRACT

A dust mop comprises a handle connected to a flexible base member of unibody configuration. The base member has a flexibly resilient top wall and flexibly resilient side and end walls. Cleaning strands of cloth or like material are attached to and extend from the base member. The top wall of the base member comprises an integrally molded spring which maintains the base member in a flat configuration. The cloth strands can be used for cleaning dust or other accumulated dirt or a disposable cleaning sheet can be wrapped around the cleaning strands and retained in position over the strands and the base member by resilient biased members integrally molded from the top wall.

9 Claims, 4 Drawing Sheets

FLEXIBLE DUST MOP

BACKGROUND OF THE INVENTION

Dust mops have long been employed as an effective and efficient cleaning tool. One type of commonly used dust mop comprises a base member with cotton, cloth, yarn, or similarly fabricated cleaning strands connected to a base member. One such common dust mop is disclosed in U.S. Pat. No. 4,794,663.

Recently, dust mops having solid cleaning head members with disposable cleaning sheets attached have become popular. These sheets are made from a variety of materials, ranging from simple cotton cloth which, when damp or containing dust spray, attracts dust, to sheets made of nonwoven synthetic cloth type material which generate a minimal electrostatic charge. The static charge in this material serves to attract and accumulate dust efficiently from dry surfaces. When such cleaning sheets are completely loaded with accumulated dust, the sheets can be washed or reused, but most conveniently, they are simply removed from the mop head, discarded, and the mop replaced with a fresh sheet. An example of the use of disposable cleaning sheets on solid mop heads is found in U.S. Pat. No. 6,098,239.

Such cleaning tools are effective in removing dust and light dirt. However, the ridgity of the head members to which these sheets are attached sometimes make it difficult to reach dirt in comers, on ledges, and other areas where dirt may accumulate and where access is limited. The present invention provides a solution to this problem.

SUMMARY OF THE INVENTION

It is thus an object of the present invention to provide a dust mop which overcomes the limitations and disadvantages of prior devices.

It is an object of the present invention to provide a flexible dust mop which is to be used with disposable cleaning sheets.

It is a further object of the present invention to provide a flexible dust mop with easy and efficient means to removably attach cleaning sheets.

It is another object of the present invention to provide a flexible dust mop which provides the option of a flexible dusting surface which employs the use of cleaning strands or a flexible dusting surface using disposable cleaning sheets.

It is still another object of the present invention to provide a mop which is flexible enough to be used to clean dirt from soiled corners, ledges, and other areas which are not readily accessible.

It is another object of the present invention to provide a dust mop which is flexible and, through the use of biasing means, resilient enough to maintain the mop in a flat configuration.

It is a further object of the present invention to provide a flexible dust mop with an integral base of unibody configuration, which is simple and economical to manufacture.

These and other objects are accomplished by the present invention which comprises a dust mop with a handle connected to a flexible base member of unibody configuration. The base member has a flexibly resilient top wall and flexibly resilient side and end walls. Cleaning strands of cloth or like material are attached to and extend from the base member. The top wall of the base member comprises an integrally molded spring which maintains the base member in a flat configuration. The cloth strands can be used for cleaning dust or other accumulated dirt or a disposable cleaning sheet can be wrapped around the cleaning strands and retained in position over the strands and the base member by resilient biased members integrally molded from the top wall.

The novel features which are considered as being characteristic of the invention are set forth in particular in the appended claims. The flexible dust mop itself, however, both as to its design, construction, and use, together with addition features and advantages thereof, are best understood upon a review of the following detailed description with reference to the accompanying drawings.

DETAILED DESCRIPTION OF THE INVENTION

Figure 1:
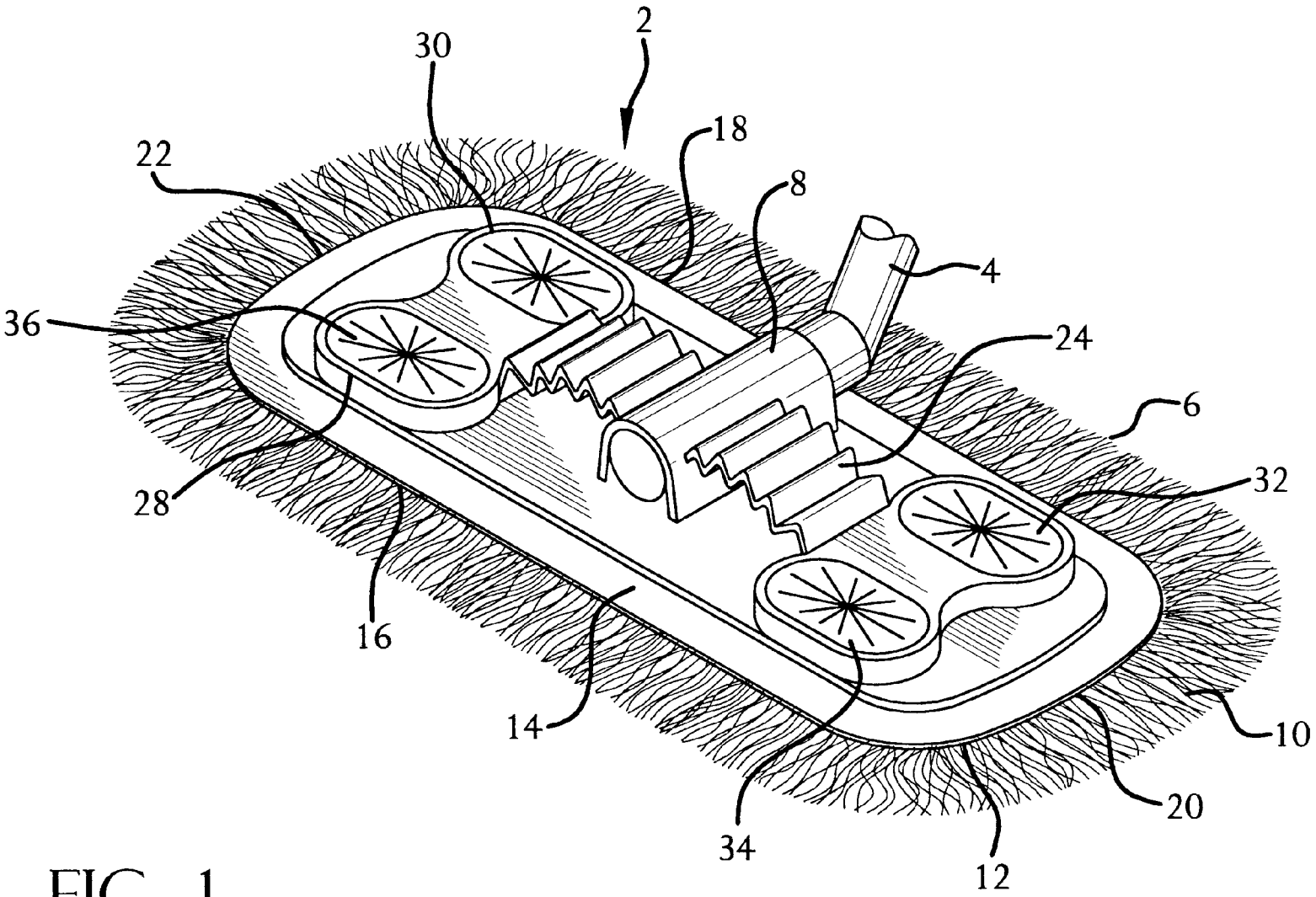
FIG. 1 is a perspective view of the mop of the present invention.

Mop 2 comprises handle 4 connected to mop head 6 by handle receiving connection 8 which is known in the art. Mop head 6 comprises cleaning strands 10 secured to mop base member 12. Base 12 is constructed of resilient, flexible plastic. It is configured of unibody, preferably molded, construction. Cleaning strands 10 are attached, for example by sewing, to base 12. Base 12 comprises flexibly resilient top wall 14, side walls 16 and 18, and end walls 20 and 22.

It can be appreciated that, given the flexibly resilient nature of base 12, mop head 6 can readily be used in a variety of configurations by folding, bending or otherwise contort the flexibly resilient side walls 16 and 18 and end walls 20 and 22. Mop head 6 thus can easily be configured for use in tight spaces or on curved or angled surfaces.

Figure 2:
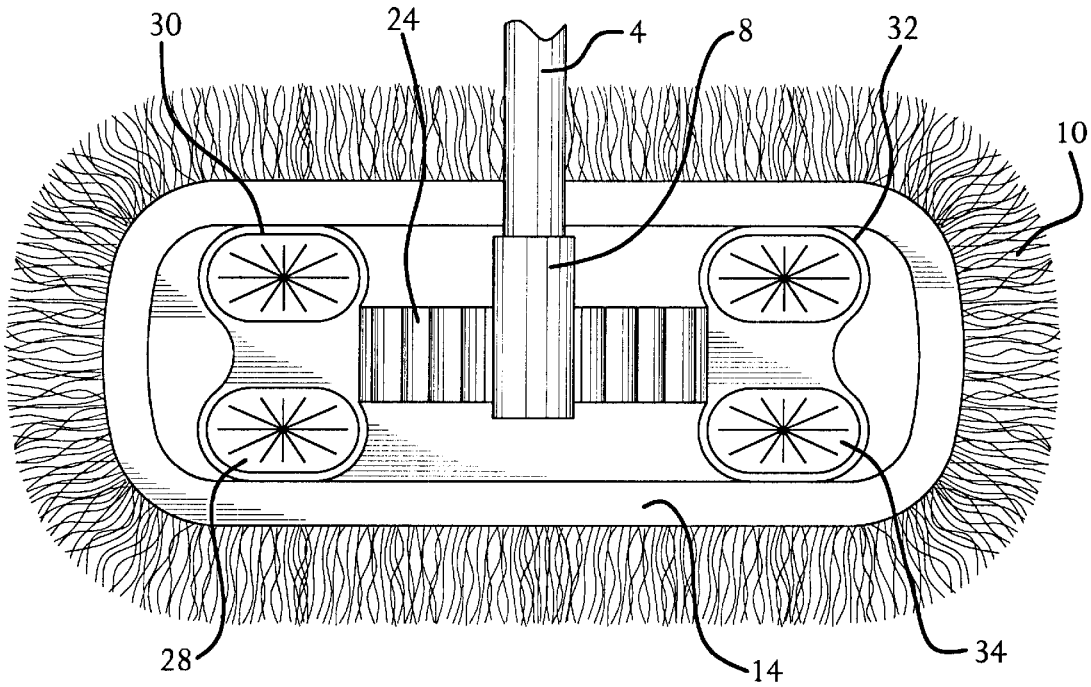
FIG. 2 is a top view of the mop of the present invention.
Figure 3:
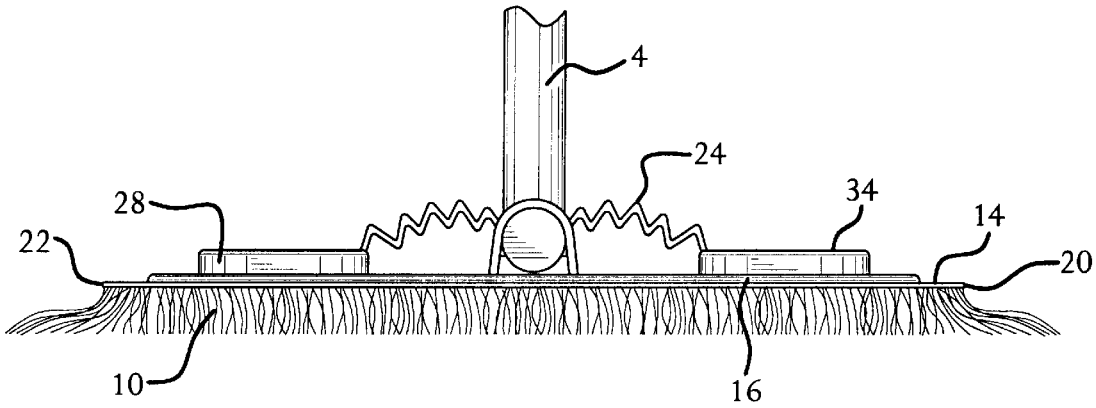
FIG. 3 is a front view of the mop of the present invention.
Figure 4:
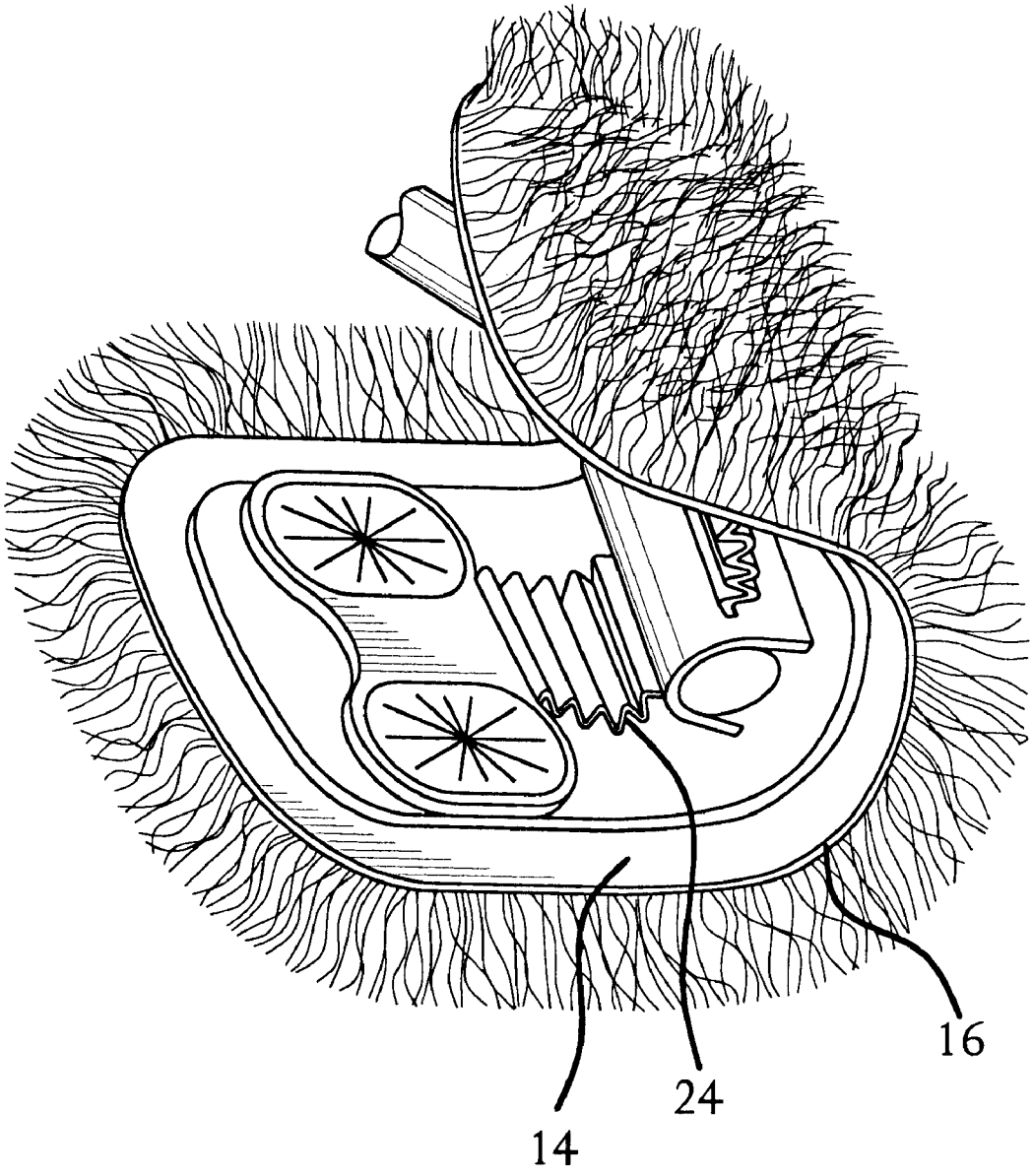
FIG. 4 is a perspective view of the mop of the present invention showing a flexible cleaning position.

However, no matter in what configuration mop head 6 is placed, after use it is always returned to and then maintained in the flat configuration, shown in FIGS. 1–3, by biasing means, disclosed herein as spring 24. While spring 24 is described, any comparable biasing means is contemplated. Spring 24, in the herein embodiment, is integrally molded with base 12. Spring 24 extends from center attachment 8 to top wall 14. Mop head 6 is readily bendable and generally contortable in nature, as shown in FIG. 4, and spring 24 returns it to its normal, flat position.

Figure 5:
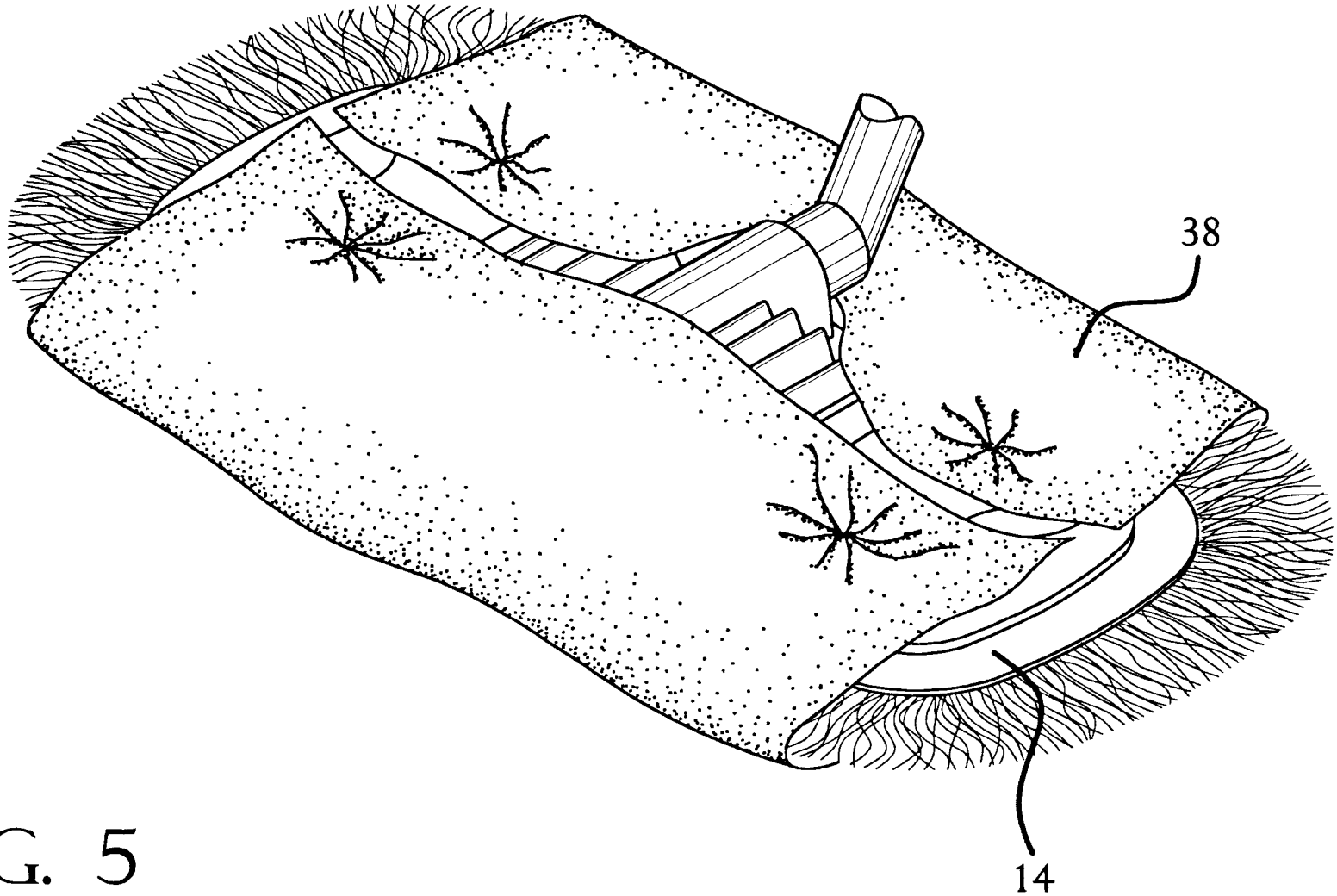
FIG. 5 is a perspective view of the mop of the present invention showing the use with a disposable cleaning sheet.

Integrally molded within top wall 14 of base 12 are resilient biased members 28, 30, 32, and 34. As seen in FIG. 5, disposable cleaning sheet 38 can be wrapped over cleaning strands 10 of mop head 6 and the edges of sheet 38 brought over top wall 14 of mop base 12. Resilient biased members 28, 30, 32, and 34, each consist of separated segments, 36, shown on member 28 in FIG. 1. Segments 36 are flexibly biased, such that by pushing a portion of cleaning sheet 38 through and into the segments of each biased member, as seen in FIG. 5, the segments hold and secure that portion of sheet 38 within the biased members. With sheet 38 secured to mop head 6 in this manner, the sheet can be used in conjunction with flexible dust mop 2 for cleaning operations.

Alternatively, of course, cleaning sheet 38 can be removed from mop head 6, simply by removing the sheet from biased members 28, 30, 32, and 34. The user then may either replace cleaning sheet 38 or commence cleaning operations directly by use of cleaning strands 10.

Thus, the flexible dust mop of the present invention provides the user with the option of using the dust mop in the conventional manner, by employing cleaning strands 10 for direct application to the cleaning process, or by means of the use of disposable cleaning sheets 38 for the cleaning process. In either operation, the user is provided with a flexible dust mop, resiliently biased for ready, easy, and efficient cleaning.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

We claim:

1. A dust mop for use with a disposable cleaning sheet, said dust mop comprising:

(a) an integral base of flexibly resilient, unibody configuration, said base having a resiliently biased top wall and resiliently biased side and end walls and receiving means for accepting a handle;

(b) a plurality of cleaning strands secured to the base; and (c) retaining means located on the top wall to secure a disposable cleaning sheet, whereby the cleaning sheet is wrapped around the cleaning strands and maintained over the strands and the base by the retaining means.

2. A dust mop as in claim 1 wherein the strands are sewn to the base.

3. A dust mop as in claim 1 further comprising flexible biased means integrally formed with the base to maintain the base in a flat configuration.

4. A dust mop as in claim 3 wherein the flexible biased means comprises a spring integrally molded with the base.

5. A dust mop as in claim 1 wherein the retaining means comprises resilient, flexibly biased members which hold the cleaning sheet in place on the base.

6. The dust mop as in claim 3 in which the retaining means comprises resilient, flexibly biased members which hold the cleaning sheet in place on the base.

7. A flexibly biased dust mop, said dust mop comprising:

(a) an integral base of flexibly resilient, unibody configuration, said base having a resiliently biased top wall and resiliently bias side and end walls and receiving means for accepting a handle;

(b) dusting strands secured to the base; and (c) flexibly biased means integrally formed with the base to biasedly maintain the base in a flat configuration.

8. The dust mop as in claim 7 in which the flexibly biased means comprises a spring integrally molded with the base.

9. The dust mop as in claim 7 wherein the strands are sewn to the base.

* * * * *